United States Patent [19]

Larson

[11] 4,079,814

[45] Mar. 21, 1978

[54] STEPLADDERS

[75] Inventor: Clayton E. Larson, Brooklyn, N.Y.

[73] Assignee: White Metal Rolling & Stamping Corporation, Brooklyn, N.Y.

[21] Appl. No.: 775,850

[22] Filed: Mar. 9, 1977

[51] Int. Cl.[2] ..... E06C 1/16

[52] U.S. Cl. ..... 182/176; 182/124; 182/217

[58] Field of Search ..... 182/165, 173, 174, 177, 182/194, 175, 176, 217, 124

[56] References Cited

U.S. PATENT DOCUMENTS

| | | | |
|---|---|---|---|
| 1,592,109 | 7/1926 | Jacobs | 182/176 |
| 1,866,974 | 7/1932 | Hohing | 182/174 |
| 3,083,786 | 4/1963 | Arnold | 182/176 |

FOREIGN PATENT DOCUMENTS

| | | | |
|---|---|---|---|
| 205,363 | 11/1956 | Australia | 182/173 |

*Primary Examiner*—Reinaldo P. Machado
*Attorney, Agent, or Firm*—Carroll F. Palmer

[57] ABSTRACT

Stepladders are made of extruded aluminum metal parts including special bracket members for the rear prop section and the bucket rack that mitigate torsional twist. Cross bracings for the rear prop section and bracings of the front section are structured to prevent pantographing or rotation and reduce to a minimum the number of rivets required for ladder assembly thereby providing strong, safe ladders of light weight and low cost.

8 Claims, 14 Drawing Figures

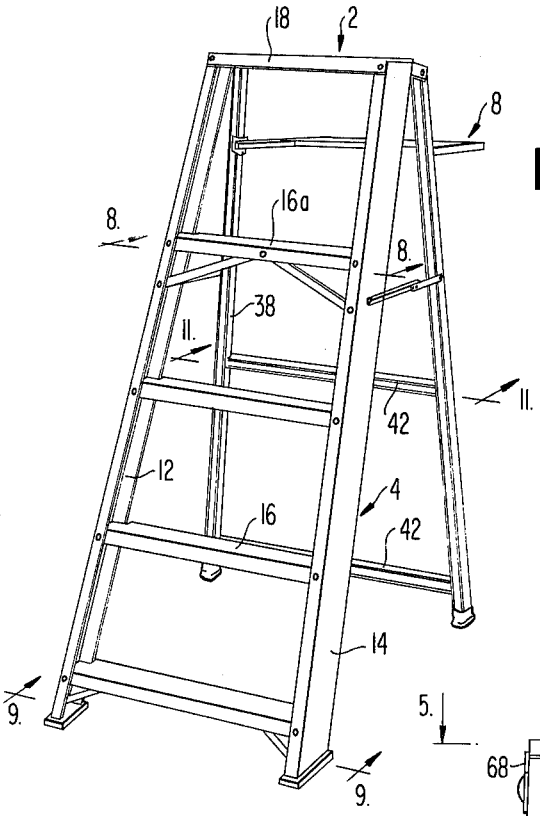
FIG 1
FIG 2
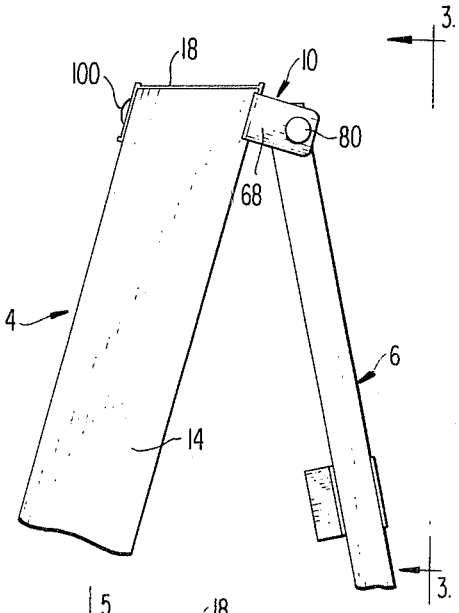
FIG 3
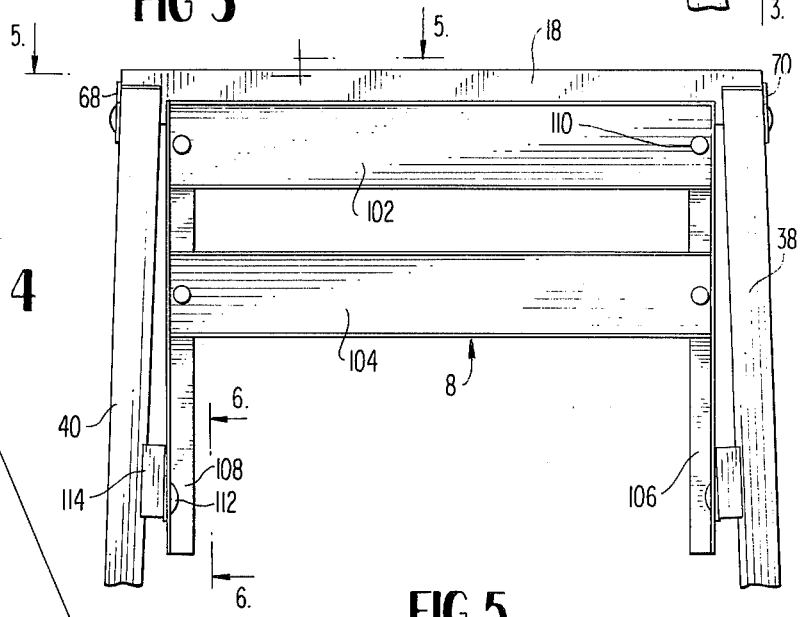
FIG 4
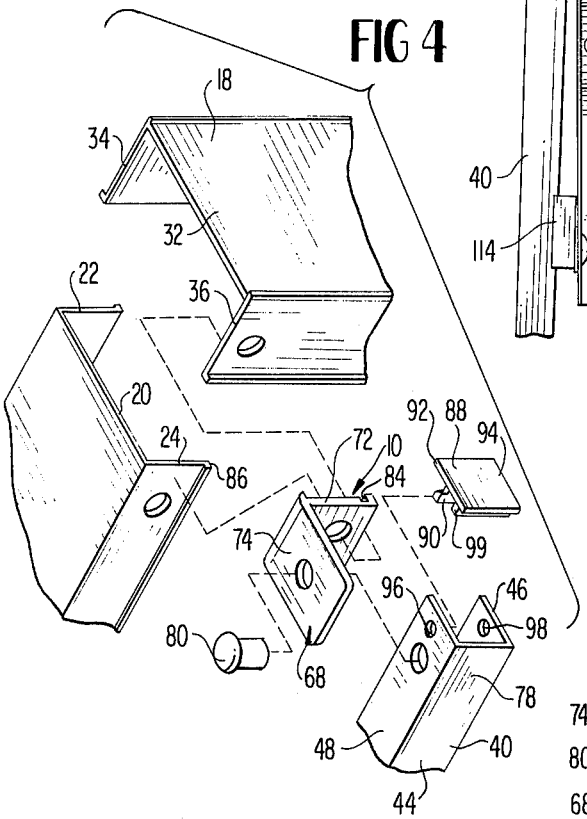
FIG 5
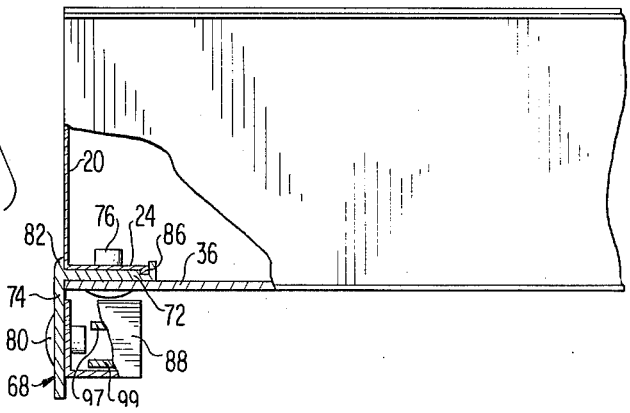

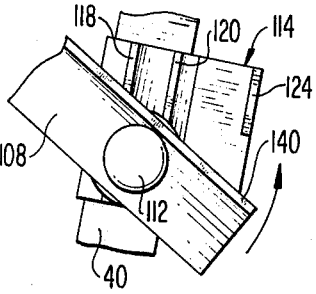
FIG 6
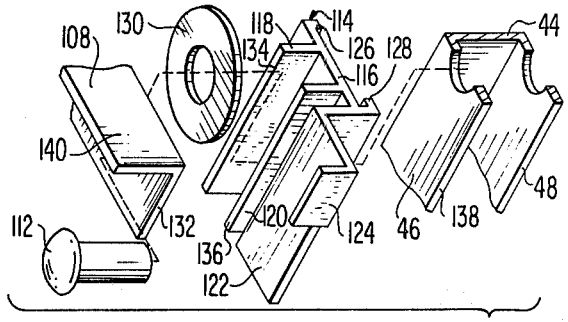
FIG 7
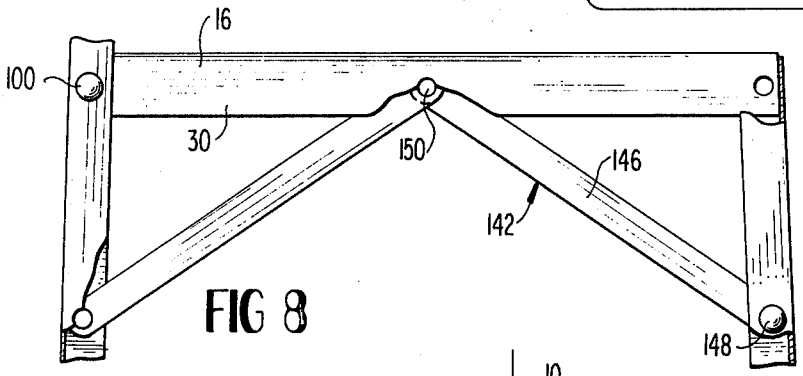
FIG 8
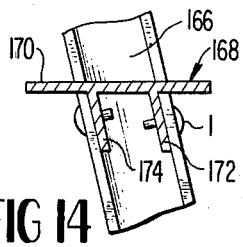
FIG 14
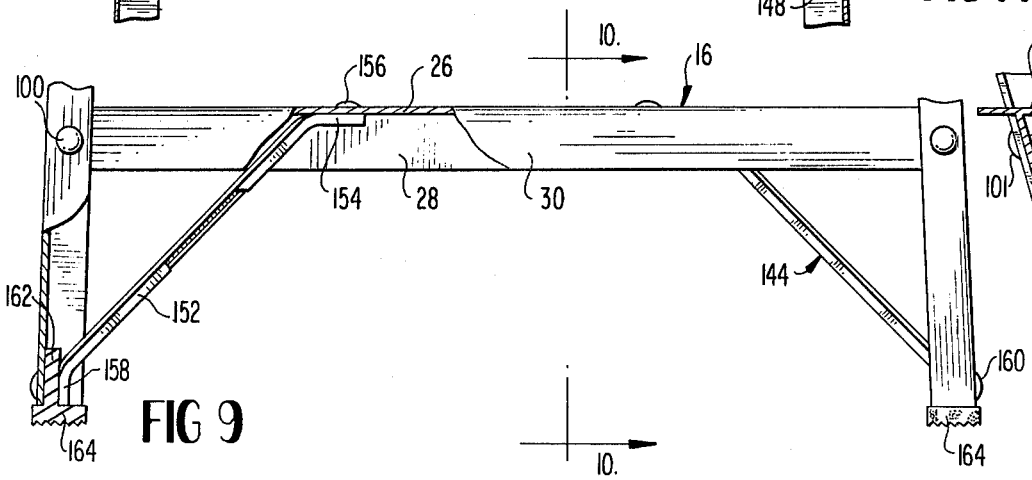
FIG 9
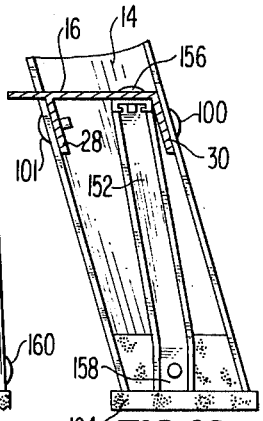
FIG 10
FIG 11
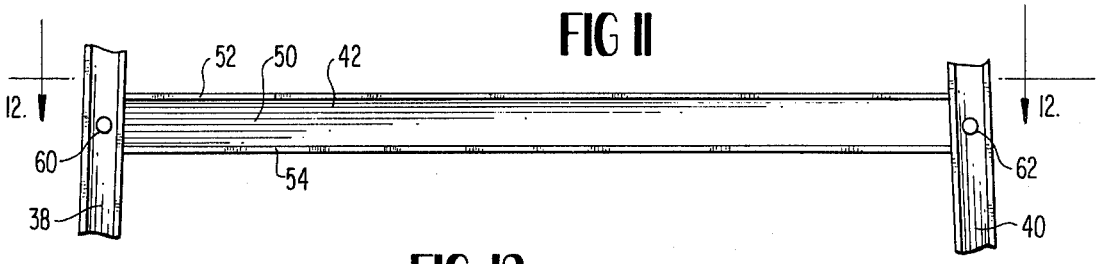
FIG 12
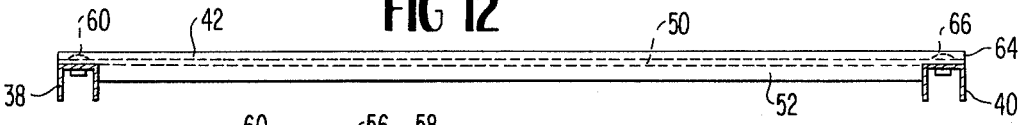
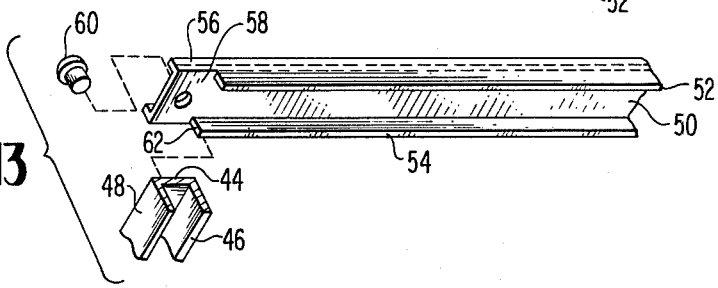
FIG 13

STEPLADDERS

BACKGROUND OF THE INVENTION

1. Field of the Invention

This invention relates to stepladders. More particularly it concerns stepladders made of extruded aluminum metal parts structured so the ladders will be extremely light and of low cost, but still strong and substantially free of torsional twisting, pantographing or relative rotation of parts.

2. Description of the Prior Art

Ladder manufacturers strive to create ladders from a minimum of parts and material to make them as light weight and as low in cost as possible. Stepladders designed with such considerations in mind are disclosed in many prior patents, e.g., U.S. Pat. Nos. 2,899,008 and 3,009,535.

There tends to be a trade-off in ladder construction between strength and stability versus light weight and minimum material of construction. Thus, as the number of parts and weight of material used in fabrication of ladders is decreased, there is an increased tendency for the strength and proper functioning of the ladders to decrease. By way of example, light weight stepladders frequently exhibit unsatisfactory torsional twisting of the rear section relative to the front section during use. Also, pantographing or rotation often occurs in the rear sections of light weight ladders. Moreover, proper bracing of the front section and bucket rack support are problems in such ladders.

Not withstanding the large number of new designs of ladders that have been developed over the years, there continues to be a need for the creation of stepladders that possess high strength and stability combined with light weight, low material requirement and low cost of fabrication.

OBJECTS

A principal object of the present invention is the provision of new improvements in stepladders. Further objects include the provision of stepladders that:

(1) Are of light weight, but have good strength and stability, (2) Are formed of extruded aluminum parts structured to require a minumum of rivets for assembly.

(3) Mitigate torsional twist, pantographing or rotation in the rear prop section.

(4) Incorporate unique front section braces.

(5) Include novel bucket rack brackets.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The foregoing objects are accomplished in accordance with the present invention by a stepladder construction that is characterized by the following features:

A. a top plate of reduced width relative to the width of the ladder steps,

B. a front section comprising metal channel side rails and steps,

C. a rear section comprising metal channel side rails and horizontal brace members that have notched out ends fitted to the side rails providing purchase or leverage to prevent pantographing or rotation without need for diagonal bracing.

D. a bucket rack pivoted on special contoured bracket members fixed by a single rivet to the rear section side rails.

E. lower front section bracings that are attached to rubber feet rivets and grasp the rubber feet in their mounting to their respective siderails.

F. upper front section bracing structured so a single rivet may be used for its attachment in the center of a step of the ladder.

BRIEF DESCRIPTION OF THE DRAWING

A more complete understanding of the new stepladders of the invention may be had by reference to the accompanying drawings in which:

FIG. 1 is a perspective view of a stepladder constructed in accordance with the invention FIG. 2 is a fragmentary side view of the top portion of the ladder FIG. 3 is a fragmentary rear view of the top portion of the ladder FIG. 4 is an exploded view of the rear section pivot bracket portion of the ladder FIG. 5 is a fragmentary sectional view taken on the line 5—5 of FIG. 3

FIG. 6 is a fragmentary sectional view taken on the line 6—6 of FIG. 3

FIG. 7 is an exploded view of the bucket rack bracket shown in FIG. 6

FIG. 8 is a sectional view taken on the line 8—8 of FIG. 1

FIG. 9 is a sectional view of the bottom portion of the ladder front section taken of the line 9—9 of FIG. 1

FIG. 10 is a sectional view taken on the line 10—10 of FIG. 9

FIG. 11 is a sectional view of the rear section brace member taken on the line 11—11 of FIG. 1

FIG. 12 is a sectional view taken on the line 12—12 of FIG. 11

FIG. 13 is an exploded view of one end of the rear section brace member shown in FIGS. 11 and 12

FIG. 14 is a sectional view of the step of a modified form of the ladders of the invention.

DESCRIPTION OF THE PREFERRED EMBODIMENTS

Referring in detail to the drawings, the new stepladder 2 comprises a front section 4, a rear section 6, a bucket rack 8 and means 10 for pivotally connecting the rear section 6 to the front section 4.

The front section 4 comprises left side rail 12 and right side rail 14, a plurality of equally spaced apart steps 16 fixed between the side rails and a top plate 18 fixed between the side rails at the top thereof. The distance between the uppermost step **16*a* and the top plate 18 is greater than the distance between the steps 16**.

The side rails are formed of channels having a face 20 and two normal legs 22 and 24. Similarly, the steps 16 are formed of channels each having a face or tread 26 and two normal legs 28 and 30. Also, top plate 18 is formed of a channel having a face 32 and two normal legs 34 and 36.

The rear section 6 comprises left side rail 38, right side rail 40 and a plurality of spaced apart, horizontal brace members 42. The side rails 38 and 40 are channels having a face portion 44 and normal leg portions 46 and 48 that extend forward of the face portion 44 in the ladder.

The brace members (see FIGS. 11–13) are I-shaped metal strips defined by the central web 50 and cross portions 52 and 54, the latter being cut on one side at the ends 56 forming a ledge 58 at each end. The face portion 44 of side rail 38 is fixed by rivet 60 to the ledge 58 with the inside leg 46 abutting the side edges 62 of the cross portions 52 and 54. The right rear side rail 40 is similarly fixed to the other end 64 of the brace member 42 by the rivet 66.

The rear section pivot means 10 comprises first and section L-shaped brackets 68 and 70. Each bracket has a base portion 72 of each of the brackets 60 and 70 is fixed by a rivet 76 between the rear legs 24 of the front side rails 12 and 14 and the rear leg 36 of the top plate 18 with the leg portion 74 of each bracket 68 and 70 extending beyond the face portion 20 of the respective front section side rails 12 and 14. The rear section side rails 38 and 40 are each pivoted at the top end 78 thereof upon the leg portion 74 by a rivet 80. Advantageously, the brackets 68 and 70 have an lug 82 that overlaps the face 20 of the side rail 12 or 14 respectively to further strengthen the bracket structure. Also, the leg portion 74 of each bracket 68 and 70 has a notch 84 that receives the bead 86 on the end of the leg 24 of the side rails 12 and 14 respectively.

The top of each rear side rail 38 and 40 is fitted with a cap 88 having lugs 90 at the sides 92 and 94 that can be locked into the holes 96 and 98 respectively in the top ends 78 of the side rails 38 and 40.

The caps 88 are strengthen by depending webs 97 and 99.

The steps 16 and top plate 18 are fixed at each side to the side rails 12 and 14 by front rivets 100 and rear rivets 101.

The bucket rack 8 comprises cross slats 102 and 104 and left and right L-shaped support members 106 and 108 respectively fixed together by the rivets 110.

The bucket rack 8 is pivoted on rivets 112 that extend through the inner legs 46 of the rear side rails 38 and 40. A Contoured bracket member 114 is held by the rivets 112 between the respective side rail 38 and 40 and the support members 106 and 108 respectively.

Each of the two bracket members 114 consists of a central web 116, two dependent webs 118 and 120, an L-shaped end portion 122, a stop element 124 and lugs 126 and 128. In the assembled ladder, a washer 130 is positioned between the vertical leg 132 of support member 106 or 108 and the exposed edges 134 and 136 of webs 118 and 120 respectively.

The lug 126 of bracket member 114 engages the face 44 of the rear side rail and the lug 128 embraces the rear edge 138 of leg 46 thereby firmly locking the bracket member 114 to its respective rear side rail 38 and 40.

As seen in FIG. 6, upon lowering the bracket rack 8 by the movement in the direction of the arrow, the rear ends 140 of the support members 106 and 108 will be stopped in a horizontal position by the stop elements 124. This bucket rack bracket arrangement, therefor, enables the rack and brackets all to be fixed upon the ladder in a fully operative manner by only two rivets. Furthermore, it allows the use of a squarely constructed bucket rack instead of a tapered one as is normal for accomodation to the flair of the front section side rails. Independent attachment of the bucket rack brackets is eliminated along with attachment rivets so that by the use of the specially contoured brackets that lock to the siderails and torsional movement thereof is prevented. The entire assembly is uniquely held, supported and hinged by a single rivet on each side.

The front section 4 is braced by upper brace means 142 and lower brace means 144. The former comprises a pair of straps 146 riveted at their outboard ends by rivets 148 to the legs 22 of the respective siderails 12 and 14. The inboard ends of straps 146 are fixed by a single rivet 150 to the leg 30 of a step e.g., the top step 16*a*.

The lower brace means 144 comprises a pair of U-shaped channel strips 152 fixed at the top end 154 to the under surface of face 26 of the bottom step 16 by rivets 156. The bottom ends 158 of the strips 152 are fixed by rivets 160 to the faces 20 of the side rails 12 and 14 with the vertical portion 162 of the T-shaped molded foot pads 164 locked in between. Hence, by the use of only four rivets the molded rubber foot pads 164 and the lower brace means 142 are fastened to the ladder providing added strength and stability to the new stepladders.

The embodiments of the new ladders as illustrated in FIGS. 1–10 have front section side rails nearly as wide as the tread 26 of the steps 16. In the modification shown in FIG. 14, the side rails 166 are narrower in width than the side rails 12 and 14. To accomodate this, the steps 168 have a tread 170 that extends both fore and aft beyond the side rail 166 and the legs 172 and 174 are set further in on the step as compared to the legs 28 and 30 of the steps 16.

CONCLUSION

New stepladder constructions have been described that prevent torsional twisting or pantographing in the rear section even though the ladder sections are made of a very limited number of parts and fasteners. These results are due, in part, to the creation of unique bracket members for the bucket rack and rear prop section. Additionally, the front section of the ladders have cross bracings that require a minimum of fasteners while providing full purchase and leverage against pantographing or rotation in the front section. Consequently, the ladders are of extremely light weight and may be produced at low cost.

The embodiments of the invention in which an exclusive property or privilege is claimed are defined as follows:

1. A metal stepladder comprising a front section including left and right side rails, a plurality of equally spaced apart steps fixed between said side rails and a top plate fixed between said side rails at the top thereof, the distance between the uppermost of said steps and said top plate being greater than the distance between said steps, each of said side rails, steps and top plate being channels having a face portion and two normal legs, the legs of the side rail channels extending inwardly of the sides of the ladder and the legs of the channels of the steps and top plate all extending downwardly relative to the upright position of the ladder, a rear section comprising left and right side rails and a plurality of spaced apart, horizontal brace members said side rails being channels having a face portion and two normal legs, said legs extending forward of their connected face portion in the ladder, means for pivotally connecting said rear section to said front section comprising first and second L-shaped brackets each having a base portion and a leg portion, the base portion of the first and second brackets being fixed by a rivet between the rear leg of the left and right front section side rails respectively and the rear leg of said top plate with the leg portion of each bracket extending beyond the face portion of the respective front section side rail, said right and left side rails of said rear section being pivoted at the top end thereof upon the leg portion of said first and second brackets respectively.

2. The stepladder of claim 1 wherein said horizontal brace members comprise I-shaped metal strips, the cross portions of which are cut away on one side thereof forming a ledge at each end and one of said rear section side rail face portions is riveted to one of said ledges and the other of said face portions is riveted to the other of said ledges with the inside leg of each rear section side rail abutting the side edges of the cross portions of said metal strip.

3. The stepladder of claim 1 that includes a bucket rack.

4. The stepladder of claim 3 wherein the bucket rack is pivoted on rivets that extend through inner legs of said rear section side rails.

5. The stepladder of claim 4 wherein a contoured bracket member is held by said rivet between the respective side rail and the bucket rack, said member having an inwardly extending lug that acts as a stop member for the bucket rack.

6. The stepladder of claim 1 having molded feet fixed at the lower end of each front section side rail by a rivet.

7. The stepladder of claim 6 wherein said rivet also fixes one end of a channel brace to the side rail lower end, the opposite end of the channel brace being fixed by a rivet to the undersurface of the lowermost step of the stepladder.

8. The stepladder of claim 1 wherein a pair of brace strips are riveted at one end thereof to the front leg portion of the top step of the ladder and rivet at the opposite end to a leg portion of the side rails of said front section.

* * * * *